US009931557B1

(12) United States Patent
Ivone, Jr. et al.

(10) Patent No.: US 9,931,557 B1
(45) Date of Patent: Apr. 3, 2018

(54) GOLF PRACTICE DEVICE

(71) Applicant: I Get It, LLC, Red Bank, NJ (US)

(72) Inventors: Enrico Ivone, Jr., Red Bank, NJ (US); Jonathan Allen Montgomery, Red Bank, NJ (US)

(73) Assignee: I Get It, LLC, Red Bank, NJ (US)

( * ) Notice: Subject to any disclaimer, the term of this patent is extended or adjusted under 35 U.S.C. 154(b) by 0 days.

(21) Appl. No.: 15/348,617

(22) Filed: Nov. 10, 2016

(51) Int. Cl.
*A63B 69/36* (2006.01)
*A63B 71/06* (2006.01)

(52) U.S. Cl.
CPC ..... *A63B 69/36* (2013.01); *A63B 69/3676* (2013.01); *A63B 71/0619* (2013.01); *A63B 2209/10* (2013.01); *A63B 2225/09* (2013.01)

(58) Field of Classification Search
CPC ..... A63B 63/08; A63B 63/00; A63B 63/06; A63B 57/357; A63B 57/40; A63B 57/00
USPC ..... 473/157–190; 273/398–402
See application file for complete search history.

(56) References Cited

U.S. PATENT DOCUMENTS 1,101,203 A * 6/1914 Lueder ..... A63B 57/40 473/189
1,442,054 A * 1/1923 Dixon ..... A63F 9/0204 273/397
1,540,350 A * 6/1925 Longenecker ..... A63B 63/08 473/158
1,844,735 A * 2/1932 Young ..... A63F 7/0628 473/191
2,220,492 A * 11/1940 Piesco ..... A63F 9/0204 273/389
2,232,569 A * 2/1941 Johnson ..... A63B 63/08 473/191
2,236,869 A * 4/1941 Daigle ..... A63B 57/40 473/182
3,511,506 A * 5/1970 Schollick ..... A63B 24/0021 273/375
3,526,405 A * 9/1970 Morris ..... A63B 63/08 473/191
3,695,610 A * 10/1972 Thompson ..... A63B 63/00 273/127 D
3,719,362 A * 3/1973 Blanchard ..... A63B 63/08 248/165
3,920,246 A * 11/1975 Contreras ..... A63B 57/40 273/127 R
5,029,867 A * 7/1991 Johnson ..... A63B 24/0021 473/191
5,154,426 A * 10/1992 Black ..... A63B 67/02 273/127 D
5,383,667 A * 1/1995 Sheely ..... A63B 63/08 473/190
5,655,972 A * 8/1997 Heitzman ..... A63B 63/08 473/172

(Continued)

*Primary Examiner* — Mark Graham
(74) *Attorney, Agent, or Firm* — Dunlap Bennett & Ludwig PLLC; Brendan E. Squire

(57) ABSTRACT

A golf chipping and putting training device supports a bucket at an angle for a golfer to practice chipping golf balls. The device includes a base support assembly configured to adjustably support the bucket at a selected angle. The device has a frontal face with a lower opening that is designed to simulate a true 4¼ inch green cup hole. A target assembly presents a target in the bucket opening. Depending on the clip mount, the flag is either static mounted or may act as a signal flag that is operable in response to a golf ball striking the target.

19 Claims, 4 Drawing Sheets

(56) References Cited

U.S. PATENT DOCUMENTS

| | | | | |
|---|---|---|---|---|
| 6,805,639 | B2 * | 10/2004 | Maruszczak | A63B 24/0021 273/127 D |
| 7,066,824 | B2 * | 6/2006 | Wenzler | A63B 69/3623 273/400 |
| 7,318,777 | B1 * | 1/2008 | Sells | A63B 69/3694 473/168 |
| 7,562,853 | B2 | 7/2009 | Mazzola | |
| 7,866,719 | B1 * | 1/2011 | Lucca | A63B 47/02 294/19.2 |

* cited by examiner

GOLF PRACTICE DEVICE

BACKGROUND OF THE INVENTION

The present invention relates to golf training devices and, more particularly, a training device for putting and chipping practice.

The invention solves the problem of being able to practice golf chip shots in a convenient area. Most conventional chip training devices require the use of a net. The problem with chipping nets is that they take time to set up. Also, these nets are not particularly stable. Other chip training devices include chip hoops. The chip hoops lay on the ground as a target and a practitioner chips a ball into it. However, even if the ball lands in the target, it more than likely it will bounce or roll out. In either event, the net or hoops are not collapsible to be stored with the practice balls and target. These devices do not permit putting practice.

As can be seen, there is a need for an improved golf putting and chipping practice device.

SUMMARY OF THE INVENTION

In one aspect of the present invention, a golf training device includes a base assembly, configurable to support an opening of a bucket at an angle relative to a ground surface and the type of shot being practiced (Putt, Chip, Pitch or Lob) and a target assembly attachable to a lip surrounding the opening of the bucket via an attachment clip, the target assembly carrying a target that is positioned at a central portion of the bucket opening. In some embodiments, a signal flag is coupled to the target assembly via a trip mechanism. In some embodiments, the flag is static and can be mounted to point to the left or the right. When the flag is mounted to point to the right, the face of the flag is framed to allow the user to add promotional artwork. When the flag is mounted pointing to the left, the flag displays the number "19". The trip mechanism is operable to move the signal flag upon a golf ball striking the target. In other embodiments, the base assembly has a front plate with an arcuate slot configured to receive an outer sidewall of the bucket and at lease one support arm extending from the front plate.

A fastener may be attached to the arcuate slot and a corresponding fastener is attachable to an outer sidewall surface of the bucket. In some aspects of the invention, the base assembly may include an angle adjustment leg that is adjustably attached to the front plate. The at least one support arm may include a first support arm pivotally attached to a left lateral side of the front plate via and a second support arm pivotally attached to a right lateral side of the front plate.

In yet other aspects of the invention, a golf training device includes a bucket having a lateral sidewall, a base wall, and an opening opposite the base wall. A base assembly is configurable to support the bucket at an angle relative to a ground surface supporting the golf training device, dependent on the type of shot being practiced (Chip, Pitch and Lob). A target assembly may be operatively coupled to a lip of the bucket and is configured to position a target in a central region of the bucket opening. In preferred embodiments, a signal flag is coupled to the target assembly and is operable to move in response to a ball striking the target in one variation and a static flag in another variation. In certain embodiments, the base assembly has a front plate with an arcuate slot configured to receive an outer surface of the bucket and a support arm attached to a side portion of the front plate. The base assembly may also have an angle adjustment leg adjustably attached to the front plate. A fastener may be attached to an edge surface of the arcuate slot and at least a portion of a side surface of the bucket. Preferably, the fastener is a hook and pile fastener.

In some embodiments, the base assembly will also be configured with an arcuate slot defined in a lower edge of the front plate. This arcuate slot is configured for providing the user a putting target. This slot configuration simulates a true 4¼ inch green cup hole.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an improved golf practice device. It is completely self contained and provides a stable target platform that may be utilized virtually anywhere a golfer may have a convenient space to putt or chip a real or practice plastic golf ball.

Figure 1:
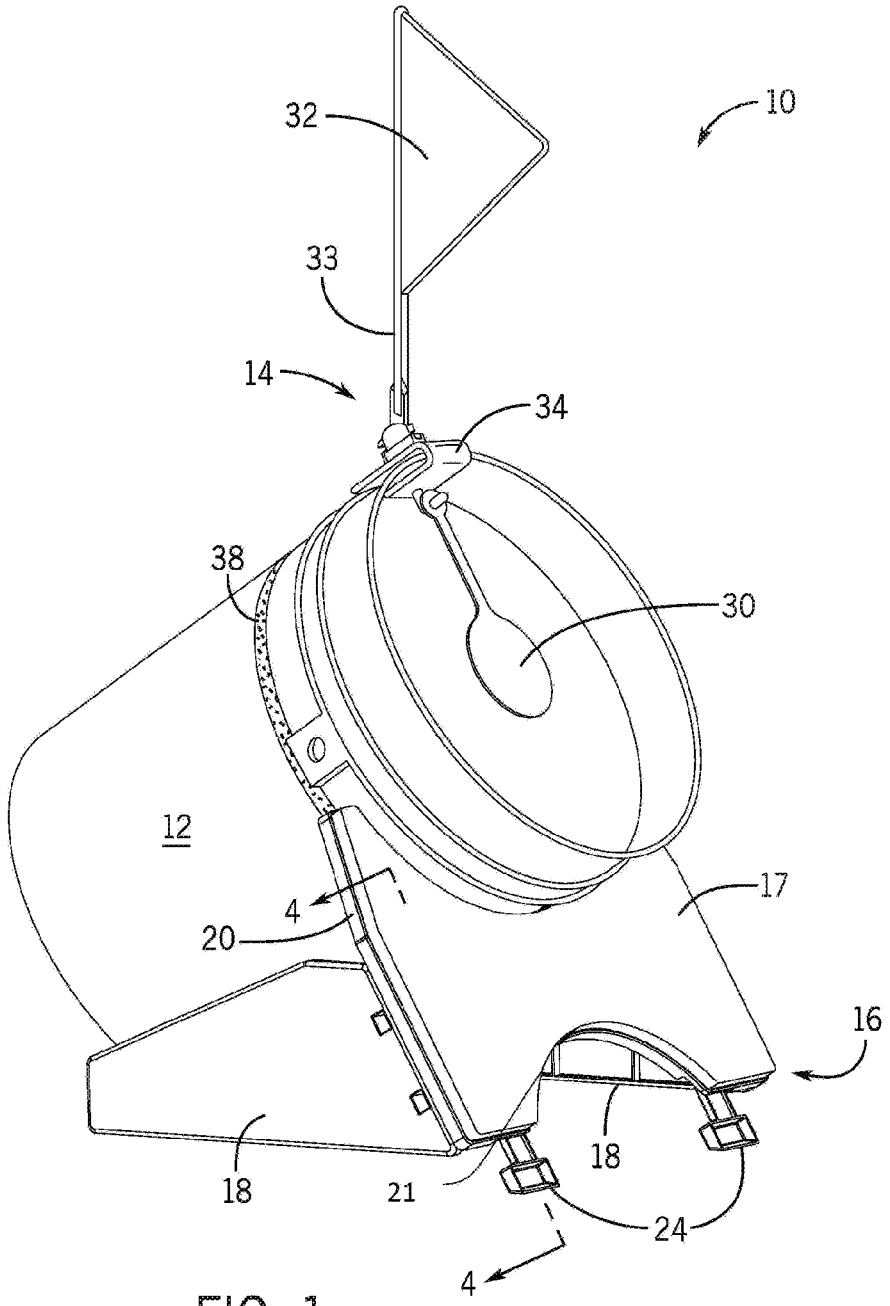
FIG. 1 is a perspective view of an embodiment of a golf practice device.
Figure 2:
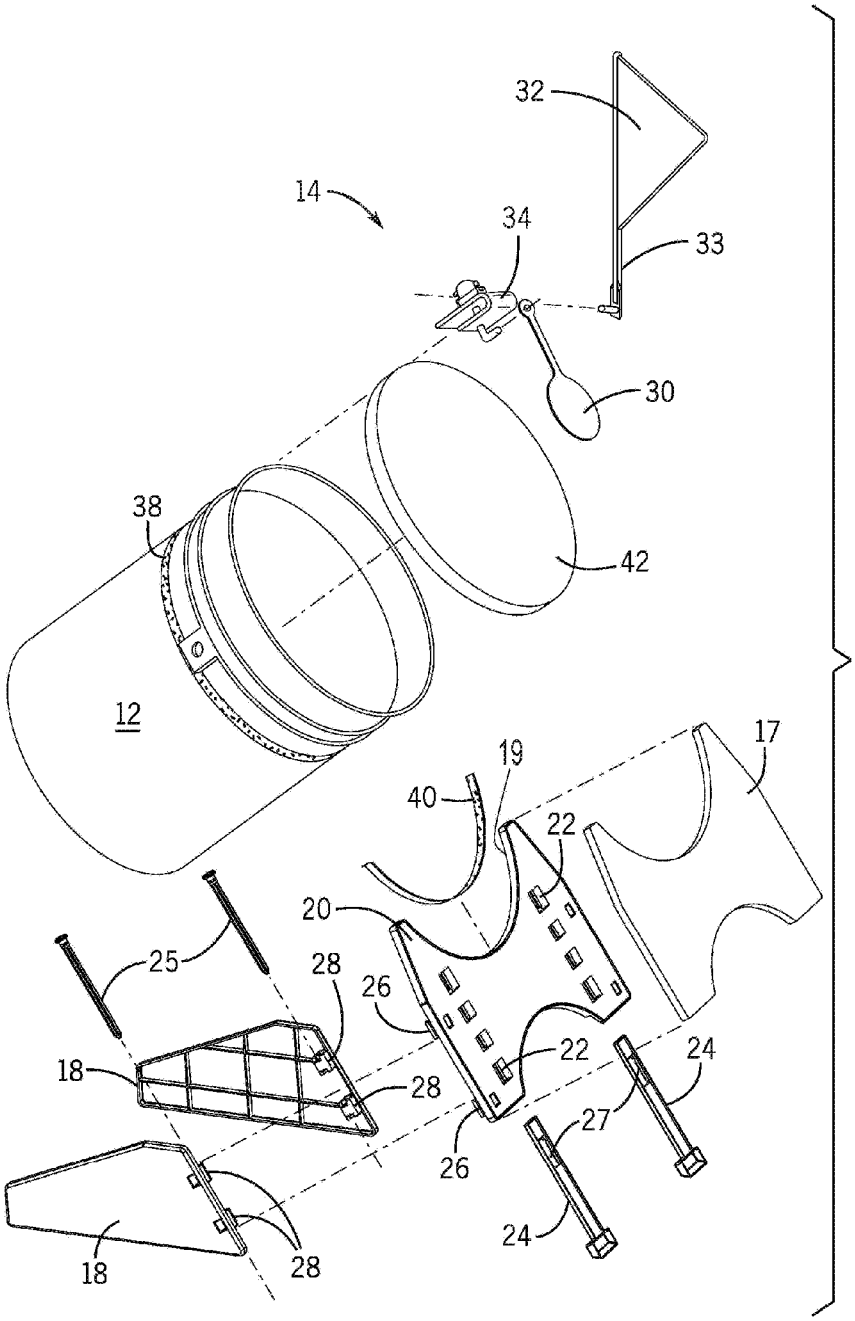
FIG. 2 is an exploded perspective view of the practice device.

As seen in reference to FIGS. 1 and 2, the chipping practice device 10 of the present invention is adapted for attachment to a bucket 12. The device 10 includes a flag assembly 14 attachable to the bucket 12, and a base assembly 16 utilized to support the bucket 12. The bucket 12 may be any conventionally sized generally cylindricalor square bucket 12, and is preferably a 5 or 6 gallon bucket 12, such as for the storage of paints, and other bulk products. The bucket 12 has a cylindrical side wall, a bottom wall, and an opening opposite the bottom wall. The device 10 may also include a pad 42 formed of an impact attenuating material, such as rubber, foam and the like. The pad 42 is configured to be received within the bucket 12 and cover the bottom wall to prevent a golf ball that may land in the bucket 12 during a practice session from bouncing off the bottom wall and exiting the bucket 12.

The base assembly 16 is configured to adjustably support the bucket 12 at an angle so that the orientation of bucket opening may be varied by the user. The base assembly 16 includes a front plate 20, which may include an impact absorbing surface 17, such as rubber or other resilient material attached to the front plate 20. The front plate 20 includes one or more slots 22 configured to adjustably receive an angle adjustment leg 24.

Figure 3:
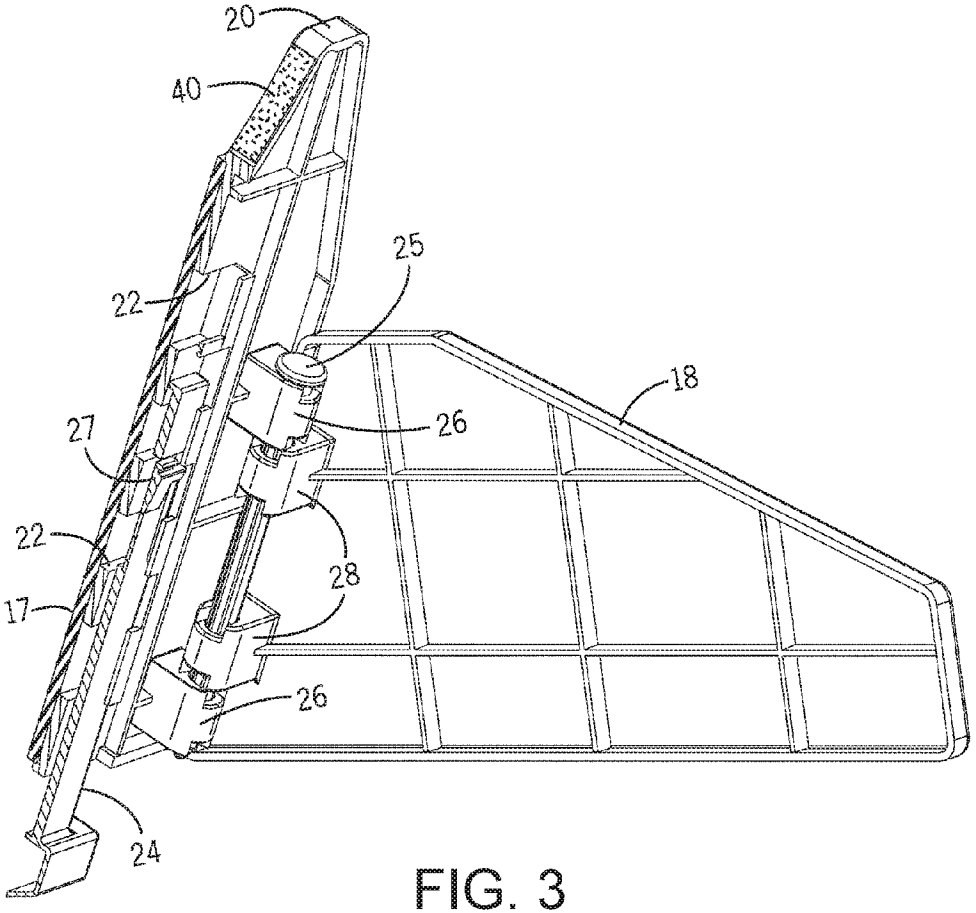
FIG. 3 is a detail perspective view of the base leg and pin assembly along line 4-4 of FIG. 1.

As best seen in reference to FIG. 3, at least one support arm 18 is attached to the front plate 20, preferably via an attachment pin 25. The attachment pin is received in a boss 26 extending from a back surface of the front plate 20 and a corresponding boss 28 extending from a face of the support arm 18. The support arm 18 may be pivoted about the attachment pin 25 such that the front plate 20 and support arm 18 may be folded flat in a stowed condition. Preferably, the base assembly 16 has a pair of support arms 18 disposed proximal to the lateral ends of the front plate 20. The folded base assembly 16 is dimensioned to be received within the bucket when not in use.

The front plate 20 may also have an arcuate slot 19 along an upper edge thereof, configured to receive an outer circumferential surface of the bucket 12 sidewall. The arcuate slot 19 is provided with a fastener 40 along an edge thereof which is selectively attachable to a corresponding fastener 38, provided about at least a portion of the outer sidewall of the bucket 12. The fasteners 38 and 40 may for example be formed of a length of cooperating hook and pile material, which are attached to the bucket 12 and slot 19 via a suitable adhesive.

The front plate 20 may also have an arcuate slot 21 defined along a lower edge thereof. Preferably, the slot 21 will have a radius corresponding to that of a conventional golf hole. The slot 21 is configured to provide a putting target, which the user may utilize as a target to practice putting. In this case, the front plate 20 may be utilized alone or in combination with the bucket 12 to provide a target for putting practice. The front plate 20 may be placed indoors, such as on a carpeted surface, or outdoors on a grass surface prepared as a putting green.

Figure 4:
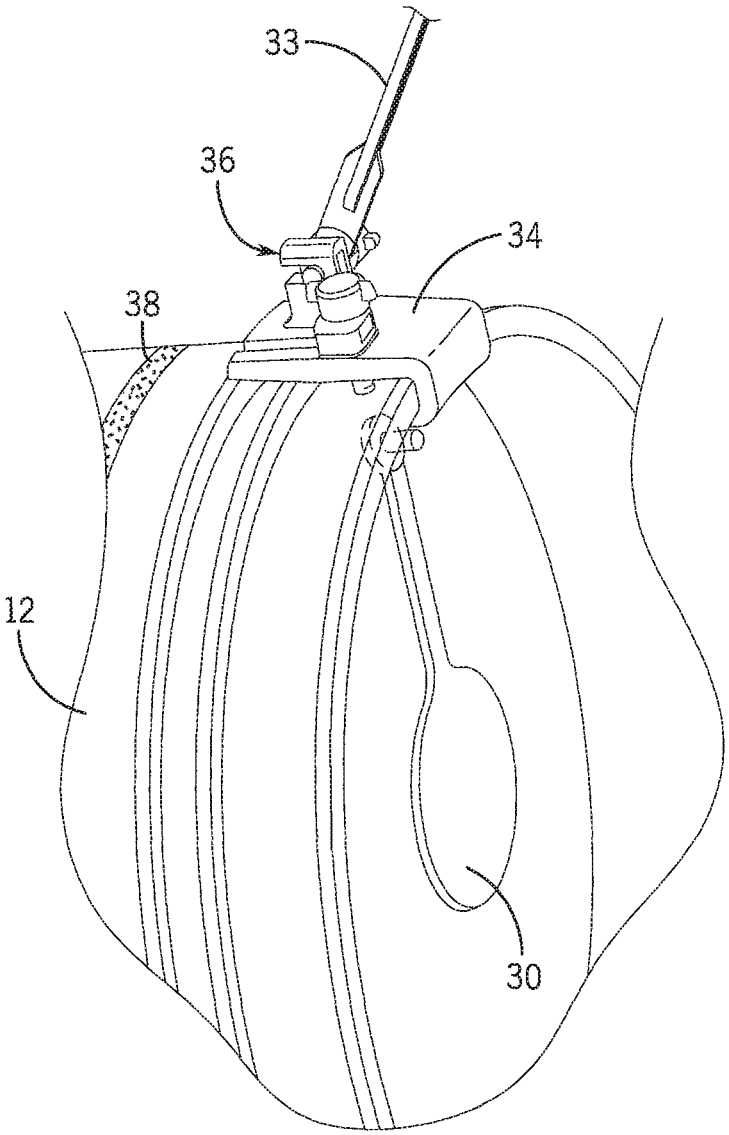
FIG. 4 is a detail perspective view of the clamp mount assembly (34) that serves as a static mount for the flag (33) and the target (30).

As best seen in reference to FIG. 4, the flag assembly 14 includes a target 30 and a signal flag 32 that are mounted via a clip 34 that is attachable to a lip surrounding the opening of the bucket 12. When configured with the trip mechanism mount, the trip mechanism 36 is included on the clip 34, which is operably coupled to a shaft 33 of a signal flag 32 and an arm of the target 30. The target 30 is configured at the end of the target arm to position the target 30 at a central portion of the bucket opening. The trip mechanism 36 is operated by a ball striking the target 30, so as to raise or lower the flag 32 when the user hits the target 30 with a golf ball during a practice session.

In use, the golfer may position the training device 10 in any suitable area that can facilitate chipping training, preferably outdoors in an open area. For short chips, the device may even be utilized indoors. The base assembly 16 may be set up by extending the legs 18 from the front face 20. The bucket 12 may then be positioned and fastened on the base assembly 16. The golfer may adjust the elevation of the front end of the base assembly 16 by manipulation of the angle adjustment leg 24, either before or after placement of the bucket 12.

When desired, the user may install the target 30 by attachment of the clip 34 to the periphery of the bucket. The user may also configure the signal flag 33 and target 30 with the mount mechanism 36.

Once the user has configured the training device 10, they may then practice their chipping by striking a golf ball towards the target 30 of the device 10. The golf balls may be either conventional regulation balls utilized for a round of golf, or may be a low density practice ball. When they have made a good chip, the ball will land within the bucket 12. For an exceptional shot, the ball will strike the target 30 and activate the signal flag 33 via the trip mechanism 36. Upon completion of a practice session, the device 10 may be disassembled and the components may be conveniently stored within the bucket 12. Preferably, the bucket 12 will include a lid (not shown) which will contain the components and a quantity of practice balls so that the golfer will have everything needed for a practice session.

It should be understood, of course, that the foregoing relates to exemplary embodiments of the invention and that modifications may be made without departing from the spirit and scope of the invention as set forth in the following claims.

What is claimed is:

1. A golf training device, comprising:

a bucket;

a base assembly having a front plate with an arcuate slot defined in an upper edge of the front plate, the arcuate slot configured to receive a lateral sidewall of the bucket and configured to support an opening of the bucket at an angle relative to a ground surface; and a target assembly having an attachment clip configured for attachment to a lip surrounding the opening of the bucket, the target assembly carrying a target that is positioned at a central portion of the bucket opening when attached to the bucket.

2. The golf training device of claim 1, further comprising:

a signal flag coupled to the target assembly via a mount mechanism.

3. The golf training device of claim 1, wherein the base assembly further comprises:

at lease one support arm extending from the front plate, the at least one support arm operable between an extended supporting position and a folded stowed position.

4. The golf training device of claim 3, further comprising:

a fastener attached to the arcuate slot; and a corresponding fastener attachable to an outer sidewall surface of the bucket.

5. The golf training device of claim 4, wherein the base assembly further comprises:

an angle adjustment leg adjustably attached to the front plate.

6. The golf training device of claim 3, wherein the at least one support arm includes a first support arm pivotally attached to a left lateral side of the front plate and a second support arm pivotally attached to a right lateral side of the front plate.

7. The golf training device of claim 4, wherein the base assembly further comprises:

the front plate having an arcuate slot defined in a lower edge thereof, configured as a putting target; and a support arm attached to a side portion of the front plate, operable between an extended supporting position and a folded stowed position.

8. The golf training device of claim 2, wherein the mount mechanism further comprises:

a trip mechanism is operable to move the signal flag upon a golf ball striking the target.

9. A golf training device, comprising:

a bucket having a lateral sidewall, a base wall, and an opening opposite the base wall;

a base assembly, having a front plate with an arcuate slot defined in an upper edge of the front plate, the arcuate slot dimensioned to receive the lateral sidewall of the bucket to support the bucket at an angle relative to a surface supporting the golf training device;

a target assembly, operatively coupled to a lip of the bucket, the target assembly configured to position a target in a central region of the bucket opening.

10. The golf training device of claim 9, further comprising:

a signal flag coupled to the target assembly and operable to move in response to a ball striking the target.

11. The golf training device of claim 10, wherein the base assembly further comprises:

a support arm attached to a side portion of the front plate.

12. The golf training device of claim 11, further comprising:

an angle adjustment leg adjustably attached to the front plate.

13. The golf training device of claim 11, further comprising:

a fastener attached to an edge surface of the arcuate slot and at least a portion of a side surface of the bucket.

14. The golf training device of claim 13, wherein the fastener is a hook and pile fastener.

15. The golf training device of claim 10, where in the base assembly further comprises:

a front plate having an arcuate slot defined in a lower edge thereof, configured as a putting target; and a support arm attached to a side portion of the front plate, operable between an extended supporting position and a folded stowed position.

16. A golf training device, comprising:

a bucket having a lateral sidewall, a base wall, an opening opposite the base wall, and a lip surrounding the opening;

a base assembly having a front plate with an arcuate slot defined in an upper edge of the front plate, a support arm attached to a side portion of the front plate, wherein the arcuate slot is dimensioned to receive the lateral sidewall of the bucket to support the bucket at an angle relative to a surface supporting the golf training device;

a target assembly, operatively coupled to the lip of the bucket, the target assembly configured to position a target in a central region of the opening.

17. The golf training device of claim 16, further comprising:

a signal flag coupled to the target assembly and operable to move in response to a ball striking the target.

18. The golf training device of claim 16, further comprising:

an angle adjustment leg adjustably attached to the front plate.

19. The golf training device of claim 16, where in the front plate further comprises:

an arched slot defined in a lower edge of the front plate, configured as a putting target.

* * * * *